US010421694B2

(12) United States Patent
Kim et al.

(10) Patent No.: US 10,421,694 B2
(45) Date of Patent: Sep. 24, 2019

(54) NANO ENERGETIC MATERIAL COMPOSITE HAVING EXPLOSION CHARACTERISTICS THROUGH OPTICAL IGNITION, AND PREPARATION METHOD THEREFOR

(71) Applicant: PUSAN NATIONAL UNIVERSITY INDUSTRY-UNIVERSITY COOPERATION FOUNDATION, Busan (KR)

(72) Inventors: Soohyung Kim, Busan (KR); Kyungnyun Kim, Andong-si (KR)

(73) Assignee: Pusan National University Industry-University Cooperation Foundation, Busan (KR)

( * ) Notice: Subject to any disclaimer, the term of this patent is extended or adjusted under 35 U.S.C. 154(b) by 223 days.

(21) Appl. No.: 15/542,817

(22) PCT Filed: Dec. 31, 2015

(86) PCT No.: PCT/KR2015/014577
§ 371 (c)(1),
(2) Date: Jul. 11, 2017

(87) PCT Pub. No.: WO2016/137110
PCT Pub. Date: Jan. 9, 2016

(65) Prior Publication Data

US 2018/0009724 A1 Jan. 11, 2018

(30) Foreign Application Priority Data

Feb. 27, 2015 (KR) ..... 10-2015-0028538

(51) Int. Cl.
*C06B 33/14* (2006.01)
*C06B 33/00* (2006.01)
(Continued)

(52) U.S. Cl.
CPC ..... *C06B 33/14* (2013.01); *C06B 27/00* (2013.01); *C06B 31/04* (2013.01); *C06B 33/00* (2013.01); *C06C 7/00* (2013.01); *C06C 9/00* (2013.01)

(58) Field of Classification Search
CPC combination set(s) only.
See application file for complete search history.

(56) References Cited

U.S. PATENT DOCUMENTS

2001/0054462 A1* 12/2001 Hagel ..... C06C 7/00 149/24
2004/0234916 A1* 11/2004 Hale ..... A61M 11/041 431/358

FOREIGN PATENT DOCUMENTS

JP 2001-082900 A 3/2001
KR 10-2005-0006670 A 1/2005
(Continued)

OTHER PUBLICATIONS

Apperson et al., "Generation of Fast Propagating Combustion and Shock Waves with Copper Oxide/Aluminum nanothermite Composites", Appl.Phys. Lett. 91, 243109 (2007) (Year: 2007).*
(Continued)

*Primary Examiner* — James E McDonough
(74) *Attorney, Agent, or Firm* — Rabin & Berdo, P.C.

(57) ABSTRACT

The present invention relates to a nano-energetic material (nEM) composite having ignition and explosion characteristics by a low-power laser pointer beam and capable of being remotely and optically ignited by adding black powder to nEM composite powder, and a method of preparing the same. The nEM composite includes: nEM composite powder; and black powder used as a mediator for initial ignition
(Continued)

to initiate ignition in response to a laser pointer beam and cause a nEM to be continuously ignited and consecutively explode by ignition heat.

10 Claims, 8 Drawing Sheets

(51) Int. Cl.

| | |
|---|---|
| ***C06B 27/00*** | (2006.01) |
| ***C06C 7/00*** | (2006.01) |
| ***C06B 31/04*** | (2006.01) |
| ***C06C 9/00*** | (2006.01) |
| *D03D 23/00* | (2006.01) |
| *D03D 43/00* | (2006.01) |

(56) References Cited

FOREIGN PATENT DOCUMENTS

| | | | |
|---|---|---|---|
| KR | 10-2009-0018735 | A | 2/2009 |
| KR | 10-2009-0114091 | A | 11/2009 |
| KR | 10-1471998 | B1 | 12/2014 |

OTHER PUBLICATIONS https://www.thoughtco.com/black-powder-composition-607336 (Year: 2017).*

* cited by examiner

NANO ENERGETIC MATERIAL COMPOSITE HAVING EXPLOSION CHARACTERISTICS THROUGH OPTICAL IGNITION, AND PREPARATION METHOD THEREFOR

TECHNICAL FIELD

The present invention relates to a nano-energetic material (nEM) composite, and more particularly, to an nEM composite having explosion characteristics by optical ignition, wherein black powder is added to nEM composite powder to enable remote optical ignition, and a method of preparing the same.

BACKGROUND ART

Nano-energetic materials (nEMs) are substances that rapidly convert chemical energy into heat and pressure-based energy when ignited by externally applied energy and consist of a nanoscale fuel and a nanoscale oxidizer.

Such NEMs, which generate high heat and pressure during initial ignition, may be applied to a variety of thermal engineering applications such as explosives, propellants, interfacial adhesives, and the like.

For initial ignition of an NEM, hot wires, mechanical impact, flames, electric sparks, and the like have typically been used.

These typical mechanical, thermal, and electrical ignition methods are very effective in ignition of nEMs, but are much affected by the ambient environment such as temperature, humidity, pressure, and the like, and necessarily require direct contact between a nEM and an external energy source, which acts as a big obstacle to application into a variety of thermal engineering systems.

To overcome these disadvantages of typical ignition methods, there is a need to develop a novel method for igniting nEMs.

Thus, a method of optically igniting a nEM has been developed. In some previous studies, research into and development of remote ignition of nEMs using a concentrated light source such as a CO2 continuous laser with a power of 10 W or more, a Nd:YAG continuous laser, or the like were conducted, and a technology for realizing ignition and explosion phenomena of an nEM using a pulsed Nd:YAG laser was proposed.

Such a high-power laser system is very effective in ignition of nEMs, but necessarily requires additional systems such as a complicated light generating device, light path control components, a cooling device, and the like to generate laser beams, and thus is large in volume and very expensive, leading to fundamentally many limitations in a variety of applications.

DISCLOSURE

Technical Problem

The present invention aims to address the problems of conventional methods of igniting nEMs and to provide an nEM composite having explosion characteristics by optical ignition, wherein black powder is added to nEM composite powder to enable remote optical ignition, and a method of preparing the same.

The present invention aims to provide a nEM composite, having explosion characteristics by optical ignition, for providing a novel method for remote optical ignition of a nEM based on a low-power laser pointer, and a method of preparing the same.

The present invention aims to provide a nEM composite having explosion characteristics by optical ignition, in which direct contact between an nEM and a light source is not needed due to ignition using low-power laser pointer beam irradiation and remote ignition is possible, and a method of preparing the same.

The present invention aims to provide a nEM composite having explosion characteristics by optical ignition using low-power laser pointer beam irradiation whereby power consumption may be reduced, the intensity of energy may be relatively easily adjusted, and miniaturization is possible, and a method of preparing the same.

The present invention aims to provide a nEM composite having explosion characteristics by optical ignition using a small portable laser pointer whereby thermal engineering application ranges may be maximized, and a method of preparing the same.

The objects of the present invention are not limited to the aforementioned objects, and other unmentioned objects will be clearly understood by those of ordinary skill in the art from the following description.

Technical Solution

The prevent invention provides a nano-energetic material (nEM) composite having explosion characteristics by optical ignition, including: nEM composite powder; and black powder mixed with the nEM composite powder and used as a mediator for initial ignition to initiate ignition in response to a laser pointer beam and cause a nEM to be continuously ignited and consecutively explode by ignition heat.

In this regard, the black powder is used as a mediator for initial ignition under a condition of a laser pointer having a power of <1,500 mW/mm$^2$.

In addition, the nEM composite powder is a mixture of aluminum (Al) nanoparticles used as a fuel material and copper oxide (CuO) nanoparticles used as an oxidizer.

In addition, the black powder is a mixture of carbon (C), sulfur (S), and potassium nitrate ($KNO_3$).

In addition, in remote ignition performed by laser pointer beam irradiation, a power intensity and irradiation distance of a laser pointer are controlled based on a pressurization rate, a combustion rate, an ignition delay time, and a total burning time.

The present invention also provides a method of preparing a nEM composite having explosion characteristics by optical ignition, including: mixing nEM composite powder; mixing black powder; and preparing nEM/black powder composite powder by mixing the nEM composite powder with the black powder, the black powder being used to initiate ignition in response to a laser pointer beam and cause a nEM to be continuously ignited and consecutively explode by ignition heat.

In this regard, the black powder is used as a mediator for initial ignition under a condition of a laser pointer having a power of <1,500 mW/mm$^2$.

In addition, the nEM composite powder is a mixture of Al nanoparticles used as a fuel material and CuO nanoparticles used as an oxidizer.

In addition, the black powder is a mixture of carbon C, S, and $KNO_3$.

In addition, the mixing of the nEM composite powder includes mixing Al nanoparticles and CuO nanoparticles at a mass ratio of Al:CuO=3:7.

In addition, the mixing of the black powder includes mixing activated carbon, S, and $KNO_3$ at a mass ratio of C:S:$KNO_3$=3:1:6.

In addition, in the preparing, the black powder (BP) and the nEM composite powder are mixed at a mass ratio of BP:nEM=2.3:7.7.

In addition, in the mixing of the nEM composite powder and the mixing of the black powder, a mixing ratio of constituents varies depending on a pressurization rate, combustion rate, ignition delay time, and total burning time of the nEM/black powder composite powder.

Advantageous Effects

According to the present invention, a nEM composite having explosion characteristics by optical ignition and a method of preparing the same have the following effects:

First, black powder is added to nEM composite powder to enable remote optical ignition.

Second, there is provided a novel method of performing remote optical ignition on a nEM using a low-power laser pointer.

Third, remote ignition can be performed without direct contact between a nEM and a light source by ignition using low-power laser pointer beam irradiation.

Fourth, due to ignition using low-power laser pointer beam irradiation, power consumption can be reduced, the intensity of energy can be relatively easily adjusted, and miniaturization is possible.

Fifth, thermal engineering application ranges of nEMs can be maximized by ignition using a small portable laser pointer.

BEST MODE

Hereinafter, exemplary embodiments of a nEM composite having explosion characteristics by optical ignition and a method of preparing the same, according to the present invention, will be described in detail.

Characteristics and advantages of the nEM composite having explosion characteristics by optical ignition and the method of preparing the same, according to the present invention, will become apparent from a detailed description of embodiments set forth herein.

Figure 1:
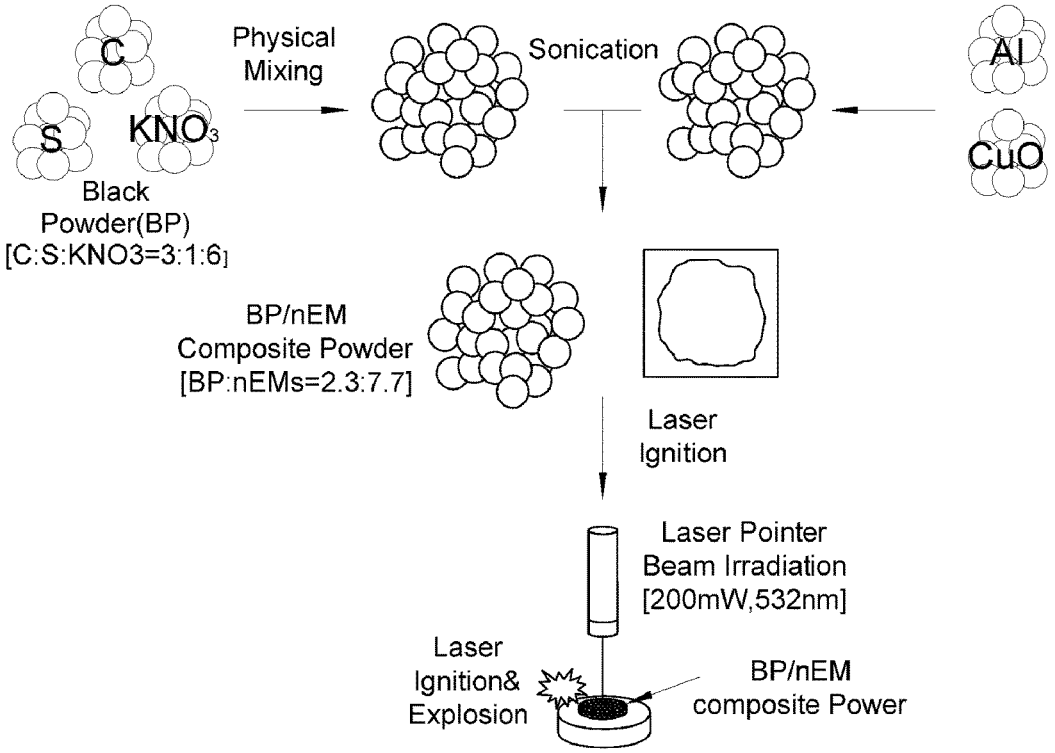
FIGS. 1 and 2 are a configuration diagram and flowchart for preparing and igniting a nEM composite having explosion characteristics by optical ignition, according to the present invention.
Figure 2:
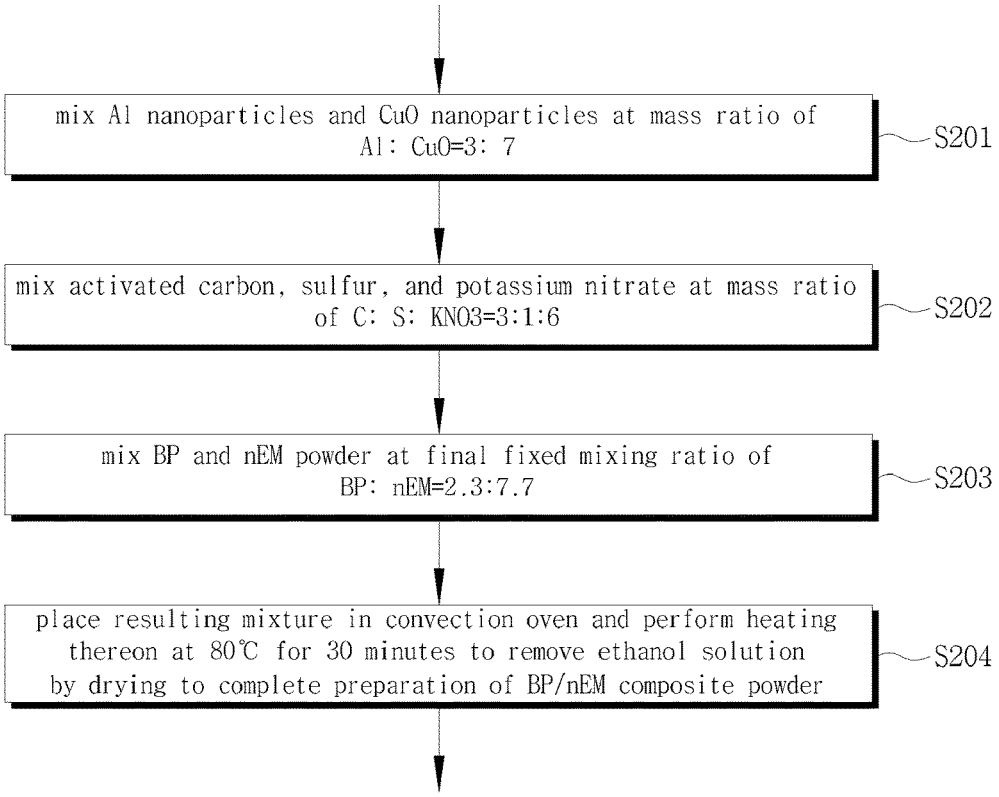

FIGS. 1 and 2 are a configuration diagram and flowchart for preparing and igniting a nEM composite having explosion characteristics by optical ignition, according to the present invention.

The present invention relates to a black powder (BP)/nano-energetic material (nEM) composite capable of being remotely ignited by a low-power laser pointer beam and a method of igniting the same, in which aluminum (Al) nanoparticles as a fuel material and copper oxide (CuO) nanoparticles as an oxidizer are uniformly mixed to synthesize nEM composite powder, and BP prepared by mixing carbon (C), sulfur (S), and potassium nitrate (KNO3) is added thereto so that the BP/nEM composite can be optically ignited remotely through irradiation with light generated from a low-power laser pointer.

As such, the present invention aims to develop a novel method of optically and remotely igniting a nEM using a low-power laser pointer.

In this regard, the power of the laser pointer may satisfy the following condition: <1,500 mW/mm$^2$, but the present invention is not limited thereto.

The nEM composite having explosion characteristics by optical ignition, according to the present invention, includes: nEM composite powder; and BP to be mixed with the nEM composite powder.

To prepare the above-described nEM composite powder, in particular, Al nanoparticles as a fuel material and copper oxide (CuO) nanoparticles as an oxidizer are uniformly mixed, thereby completing the synthesis of nEM composite powder.

BP prepared by mixing C, S, and $KNO_3$ is added to the nEM composite powder, thereby enabling remote optical ignition through irradiation with light generated from a low-power laser pointer.

Here, BP is the oldest explosive and combustion material, having been used by mankind for about 800 years or more, and even now, is applied to a variety of thermal engineering applications such as fireworks, military weapons, industrial explosives, and the like. An initial reaction of BP is mainly a reaction between sulfur and oxyhydrocarbons (OHCs) present in charcoal at a relatively low temperature, i.e., about 150° C. to about 200° C., followed by an oxidation reaction of charcoal by $KNO_3$ as a consecutive main reaction.

In an embodiment of the present invention, BP added to the nEM starts to be ignited in response to a low-power laser pointer beam having an output of 200 mW and a beam diameter of 0.50 mm, and the nEM is continuously ignited and consecutively explodes by the ignition heat.

In addition, In an embodiment of the present invention includes a configuration for efficiently controlling ignition and explosion by analyzing ignition and explosion characteristics according to a distance between a low-power laser pointer light source and the nEM/BP composition powder.

In particular, to observe ignition, combustion and explosion characteristics of the nEM during relatively low power laser pointer beam irradiation, a pressurization rate, a combustion rate, an ignition delay time, a total burning time, and the like are measured and analyzed.

In one embodiment of the present invention, Al (NT Base, Korea) nanoparticles having an average diameter of ~80 nm are used as a fuel metal material, and CuO (Sigma Aldrich, Korea) nanoparticles having an average diameter of ~100 nm are used as a metal oxidizer. BP uses activated carbon (C) (Dong Sung Co. Ltd., Korea), S (Sigma-Aldrich), and $KNO_3$ (Sigma-Aldrich).

In particular, as illustrated in FIG. 2, Al nanoparticles and CuO nanoparticles are mixed at a mass ratio of Al:CuO=3:7 (operation S201).

Then, C, S, and $KNO_3$ are mixed at a mass ratio of C:S:$KNO_3$=3:1:6 (operation S202).

Subsequently, BP and the nEM powder are mixed at a final fixed mixing ratio of BP:nEM=2.3:7.7 (operation S203).

The resulting mixture is put in a convection oven and heated at 80 □ for 30 minutes to remove an ethanol solution by drying, thereby completing the preparation of BP/nEM composite powder (operation S204).

A process of preparing the nEM composite having explosion characteristics by optical ignition, according to the present invention, will be described in more detail as follows.

As illustrated in FIG. 1, BP/nEM composite powder is prepared.

At this time, BP is used as an optical ignition agent so that a good ignition reaction occurs during low-power laser pointer beam irradiation, and is used a mediator for initial ignition to cause consecutive explosions of neighboring nEMs by initial ignition of BP.

In the BP/nEM composite powder, first, the nEM is prepared by mixing Al nanoparticles and CuO nanoparticles at a mass ratio of Al:CuO=3:7, and the BP is prepared by mixing C, S, and $KNO_3$ at a mass ratio of C:S:$KNO_3$=3:1:6.

A final mixing ratio of BP to nEM powder is fixed at 2.3:7.7 (BP:nEM), and BP and nEM powder are mixed at the fixed mixing ratio.

To prepare BP/nEM (i.e., C/S/$KNO_3$/Al/CuO) composite powder, the resulting mixture is mixed for 30 minutes by applying ultrasonication energy (ultrasonic power=170 W and ultrasonic frequency=40 kHz) thereto in an ethanol solution.

Colloidal fluid thus prepared is put in a convection oven and heated at 80□ for 30 minutes to remove the ethanol solution by drying, thereby completing the preparation of BP/nEM composite powder.

To observe optical ignition and explosion characteristics in air of the BP/nEM composite powder according to the intensity of energy per unit area of a laser pointer beam and the content of BP in the nEM, a remote ignition test is performed at various distances by a low-power laser pointer beam as follows.

The remote ignition test described below is provided only as one embodiment of the present invention, and thus the present invention is not limited to the following conditions when performing an actual test.

A laser pointer used is a continuous laser having a wavelength of 532 nm, a power of 200 mW, and a beam diameter of about 0.5 mm.

26 mg of each of nEM powder and BP/nEM composite powder is prepared and circularly aligned (diameter: 8 mm) on an Al substrate, and then each circularly aligned powder is remotely irradiated with a low-power laser pointer beam.

At this time, ignition and explosion reactions of each of the nEM powder and the BP/nEM composite powder in air at atmospheric pressure are photographed at a frame rate of 30 kHz using a high-speed camera (Photron, FASTCAM SA3 120K).

The high-speed camera used has a maximum frame rate of 1,200,000 fps, a minimum frame rate of 60 fps, a sensor size of 17.4 mm×17.4 mm (CMOS Image Sensor), a pixel size of 17 μm×17 μm, and operating voltage and power conditions: DC 22 V to 32 V, 100 W, AC 100 V to 240 V, 10 Hz to 60 Hz, and 60 W.

A pressure cell tester (PCT) used to measure an explosion pressurization rate of the BP/nEM composite powder consists of a pressure sensor (PCB Piezotronics, Model No. 113A03), a signal amplifier (PCB Piezotronics, Model No. 422E11), a signal converter (PCB Piezotronics, Model No. 480C02), an oscilloscope (Tektronix, TDS 2012B), and the like.

Scanning electron microscopy (SEM) (Hitachi, S4700) used to observe physical shape properties of the BP/nEM composite powder is performed at an operating voltage of 15 kV, and transmission electron microscopy (TEM) (Cs-corrected scanning transmission electron microscopy: HR-STEM, JEOL, JEM-2100F) is performed at an electron accelerating voltage of 200 kV.

In addition, X-ray diffraction (XRD) analysis (Philips, X'pert PROMRD) is performed to observe crystal structures of reactants, and an X-ray source is set to 3 kW, the wavelength (Cu Ka) is adjusted to 1.5405, and the measurement angle is adjusted to 10° to 90°.

In addition, to analyze thermal properties of BP/nEM, differential scanning calorimetry (DSC) (Setaram, Model No. LABSYS evo) is performed at a measurement temperature ranging from 30° C. to 1,000° C. and a heating rate of 20° C./min.

First, synthesis of BP/nEM composite powder and analysis of physical and chemical properties thereof will now be described.

To investigate a physical structure of BP/nEM composite powder, a mixed state of reactants, chemical composition thereof, and the like, SEM/TEM/STEM/XRD-based analysis of physical and chemical characteristics is performed. From SEM images (not shown), it can be observed that primary particles of Al, CuO, C, S, and $KNO_3$, which are reactants of BP/nEM, are relatively uniformly mixed, and have a little weak binding structure therebetween.

This can be observed more particularly from physical distribution and chemical composition analysis results of TEM and STEM (not shown), and these images clearly show that a nEM (i.e., Al/CuO composite nanoparticles) and BP (i.e., C/S/$KNO_3$)-based reactants are uniformly dispersed and mixed at a microscale or nanoscale distance.

A known reaction scheme of BP alone is as follows:

$$2KNO_3+S+3C \rightarrow K_2S(s)+N_2(g)+3CO_2(g) \quad \text{<Chemical Scheme 1>}$$

After BP is ignited and explodes by applying external energy thereto, sulfur reacts with potassium to form potassium sulfide, carbon reacts with oxygen to form carbon dioxide gas, and nitrogen gas is additionally generated.

In addition, a known reaction scheme of an Al/CuO nanoparticles-based nEM alone is as follows:

$$2Al+3CuO \rightarrow 3Cu(s)+Al_2O_3(s) \quad \text{<Chemical Scheme 2>}$$

That is, Al as a fuel metal and CuO as a metal oxidizer are subjected to ignition and explosion reactions by application of external energy, and then Al reacts with O to form $Al_2O_3$, which is aluminum oxide, and, in the thermal reaction, CuO supplies oxygen to the Al fuel metal and is generated as Cu, which is a pure metal.

To analyze these reactants and reaction products of BP and the nEM before and after ignition and explosion, XRD analysis is performed on the BP/nEM composite powder as follows.

Figure 3:
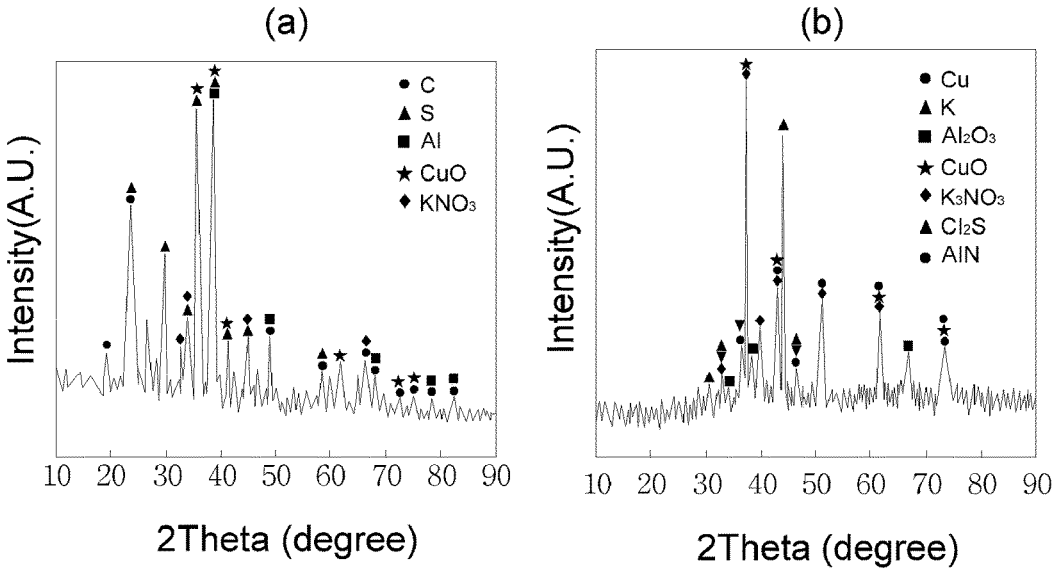
FIG. 3 illustrates graphs showing X-ray diffraction (XRD) measurement and analysis results of reactants/reaction product of black powder (BP)/nEM composite powder before ignition (a) and after ignition (b).

As shown in FIG. 3(*a*), strong signals of Al and CuO crystals by X-ray irradiation are observed from Al nanoparticles as a fuel metal and CuO nanoparticles as a metal oxidizer, and strong mixed signals are observed from crystals of C, S, and $KNO_3$, which are constituents of BP.

This means that BP/nEM composite powder is satisfactorily formed through the preparation process according to the present invention.

Such BP/nEM composite powder is artificially ignited and consecutively exploded, the reaction products are sampled, and then XRD analysis is performed thereon. As a result of XRD analysis, as illustrated in FIG. 3(*b*), materials generated after combustion of the BP/nEM composite powder are observed.

As a result, $Al_2O_3$, Cu, and the like, which are generally known as thermochemical reaction products of BP and nEM, can be observed, and $K_3NO_3$, $Cu_2S$, AlN, K, CuO, and the like, which are determined to be generated by a combination of thermochemical reactions of the two reactant groups, can be observed additionally.

In addition, thermal analysis of the BP/nEM composite powder and the explosion characteristics thereof during thermal ignition will be described as follows.

First, the thermal property of the BP/nEM composite powder prepared using the method according to the present invention is analyzed using a differential scanning calorimeter (DSC) as follows.

Figure 4:
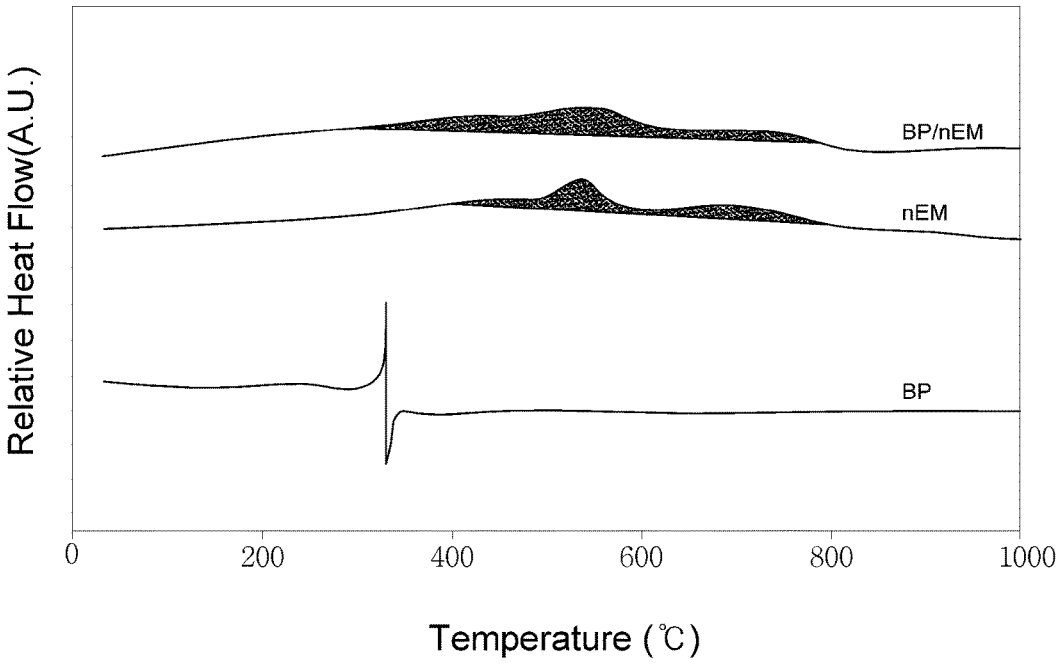
FIG. 4 is a graph showing measurement results of differential scanning calorimeter (DSC)-based thermal analysis characteristics of BP powder, nEM powder, and BP/nEM composite powder.

From DSC relative analysis results of nEM powder and BP/nEM composite powder, shown in FIG. 4, it can be confirmed that BP (C/S/$KNO_3$) powder starts to be ignited at a relatively low temperature, i.e., about 300° C. to about 350° C. and an exothermic reaction occurs, nEM (Al/CuO) powder is ignited at about 500° C. to about 560° C. and an exothermic reaction occurs, and in the case of BP/nEM composite powder, BP starts to be ignited at about 300° C., which then causes an exothermic reaction to gradually occur at a relatively low temperature, and the exothermic reaction is maximized at about 500° C. to about 560° C. and then gradually decreases.

A gross calorific value of each reactant is calculated by integrating a thermal energy generation amount thereof, and, as a result of calculation, it is determined that the BP powder has a gross calorific value of 0.24 kJ/g, the nEM powder has a gross calorific value of 2.28 kJ/g, and the BP/nEM composite powder has a gross calorific value of 3.24 kJ/g.

Next, for relative comparison, first, each of the BP powder, the nEM powder, and the BP/nEM composite powder is thermally ignited in air using Joule heating of a tungsten coil and explosive reaction characteristics thereof are observed using a pressure cell tester (PCT) and a high-speed camera as follows.

A maximum pressure generated when the BP/nEM composite powder is thermally ignited is measured using a pressure sensor system and a pressurization rate is determined using a ratio of a maximum pressure increase to duration. In addition, an ignition delay time, a burn rate, a total burning time, and the like are determined through high-speed camera measurement-based moving and still image analysis of the explosion reaction.

Figure 5:
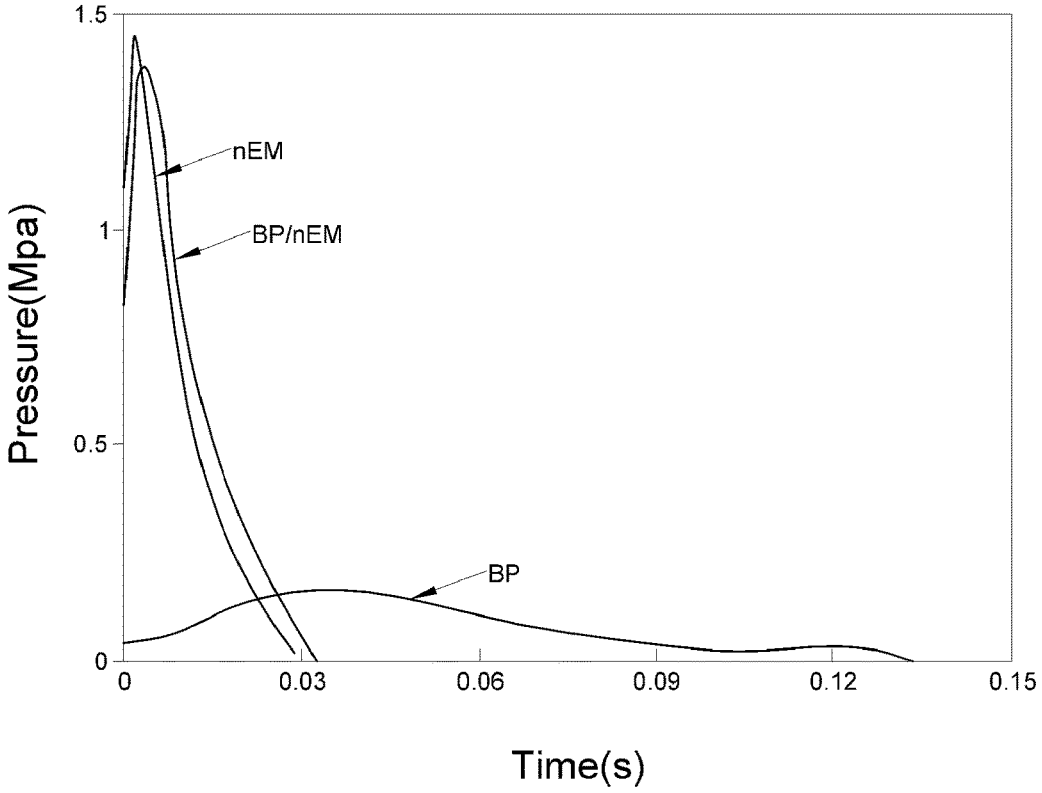
FIG. 5 is a graph showing closed pressure cell tester (PCT) measurement and analysis results of BP powder, nEM powder, and BP/nEM composite powder during thermal ignition by a tungsten coil.

As seen from the PCT measurement results of FIG. 5, in thermal ignition by an electric coil according to each powder, the three types of powder have a maximum explosion pressure of 0.16 MPa@BP, 1.43 MPa@nEM, and 1.39 MPa@BP/nEM, respectively and have a duration up to the maximum explosion pressure of 0.0592 s @BP, 0.00152 s@nEM, and 0.0035@BP/nEM, respectively.

Pressurization rates finally determined therefrom of the BP power, the nEM powder, and the BP/nEM composite powder are 2.7 MPa/s@BP, 945.4 MPa/s@nEM, and 398 MPa/s @BP/nEM, respectively.

Explosion characteristics of the BP/nEM composite powder when ignited by a low-power laser pointer beam will be described as follows.

Ignition and explosion possibilities of the nEM powder and the BP/nEM composite powder, circularly aligned, are tested by 200 mW low-power laser pointer beam irradiation as follows.

For example, in a case in which a distance between a laser pointer and each powder is about 30 cm, both the nEM powder and the BP/nEM composite powder are repeatedly ignited and explode stably and successfully by laser pointer beam irradiation.

However, in a case in which the distance between a laser pointer and each powder is about 50 cm, the BP/nEM composite powder is instantaneously ignited and explodes, while the nEM powder is not ignited and does not explode even through laser pointer beam irradiation for a long period of time.

It may be determined that pure nEM powder is unable to generate sufficient initial ignition heat by laser pointer beam irradiation and thus cannot be ignited.

In addition, to accurately analyze remote ignition of the nEM powder and the BP/nEM composite powder (a mixing ratio of BP to nEMs=2.3:7.7) by 200 mW low-power laser pointer beam irradiation and explosion flame spreading characteristics thereof in air, high-speed camera measurement and still image analysis are performed as follows.

Figure 6:
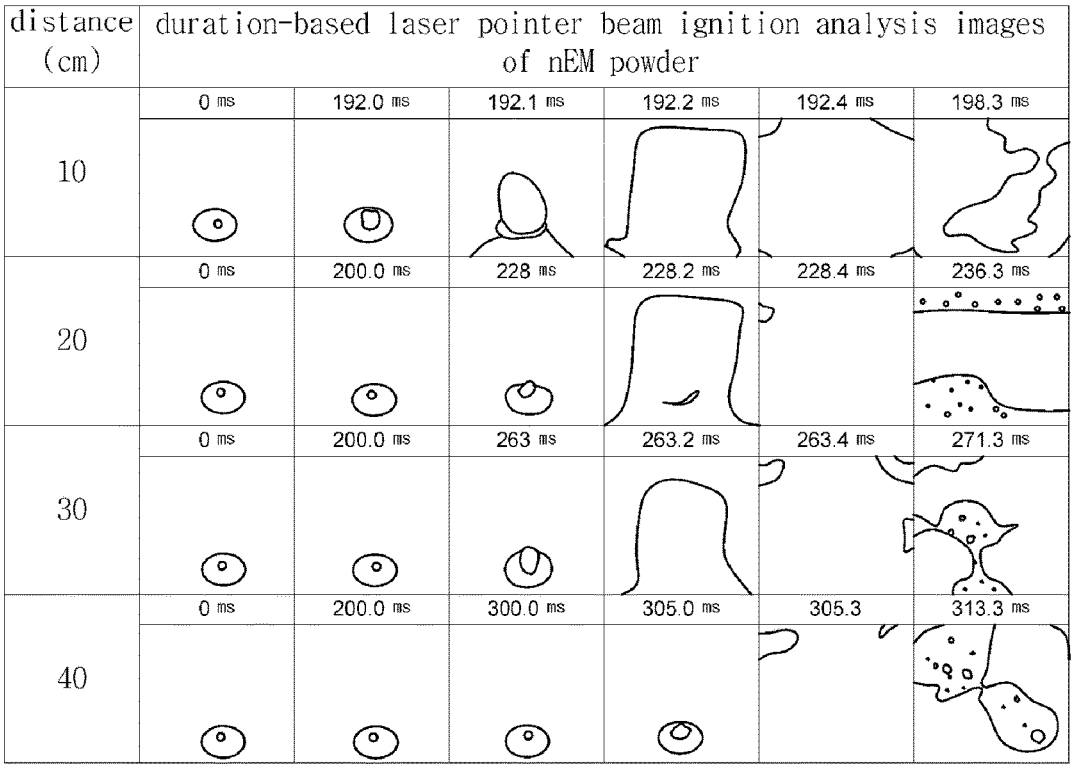
FIG. 6 illustrates continuous and still images showing high-speed camera measurement results of ignition of nEM powder by 200 mW low-power laser beam pointer beam irradiation and explosion characteristics thereof.
Figure 7:
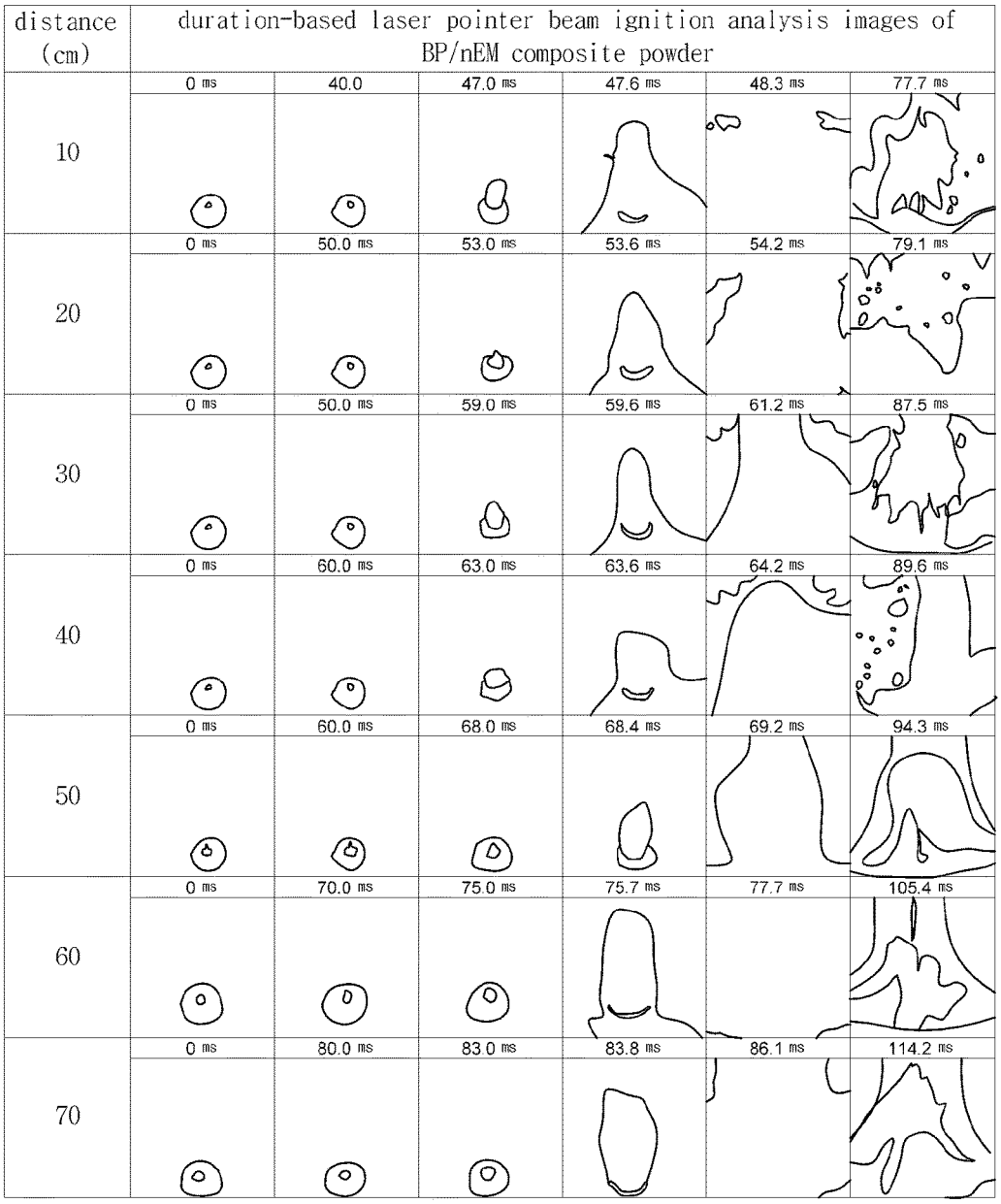
FIG. 7 illustrates continuous and still images showing high-speed camera measurement results of ignition of BP/nEM composite powder by 200 mW low-power laser pointer beam irradiation and explosion characteristics thereof.

Based on high-speed camera measurement still image results shown in FIGS. 6 and 7, an ignition delay time, total burning time, burn rate, and the like of the nEM powder and the BP/nEM composite powder are determined.

In this regard, the ignition delay time of the nEM powder and the BP/nEM powder refers to a total time taken, immediately prior to the onset of initial ignition after a laser pointer beam reaches a surface of each powder, the total burning time refers to time taken until generated explosion flames completely disappear immediately after ignition, and the burn rate is determined by division by total time taken until flames generated by laser pointer beam irradiation reaches opposite ends of the nEM powder sample or the BP/nEM composite powder sample, aligned in a disk form, starting from the center of the powder sample.

As seen from common results shown in FIGS. 6 and 7, it can be confirmed that ignition and explosion reactions of the nEM powder and the BP/nEM composite powder are successfully induced by low-power continuous laser pointer beam irradiation in a specific distance area according to the type of powder.

That is, when the nEM powder and the BP/nEM composite powder are exposed to a low-power laser pointer beam, local ignition occurs when a certain period of time passes after absorption of laser light energy, high-temperature flames are generated while initial thermal energy is being gradually transferred to neighboring nEM powder particles, and, finally, ignition and explosion macroscopically occur.

Figure 8:
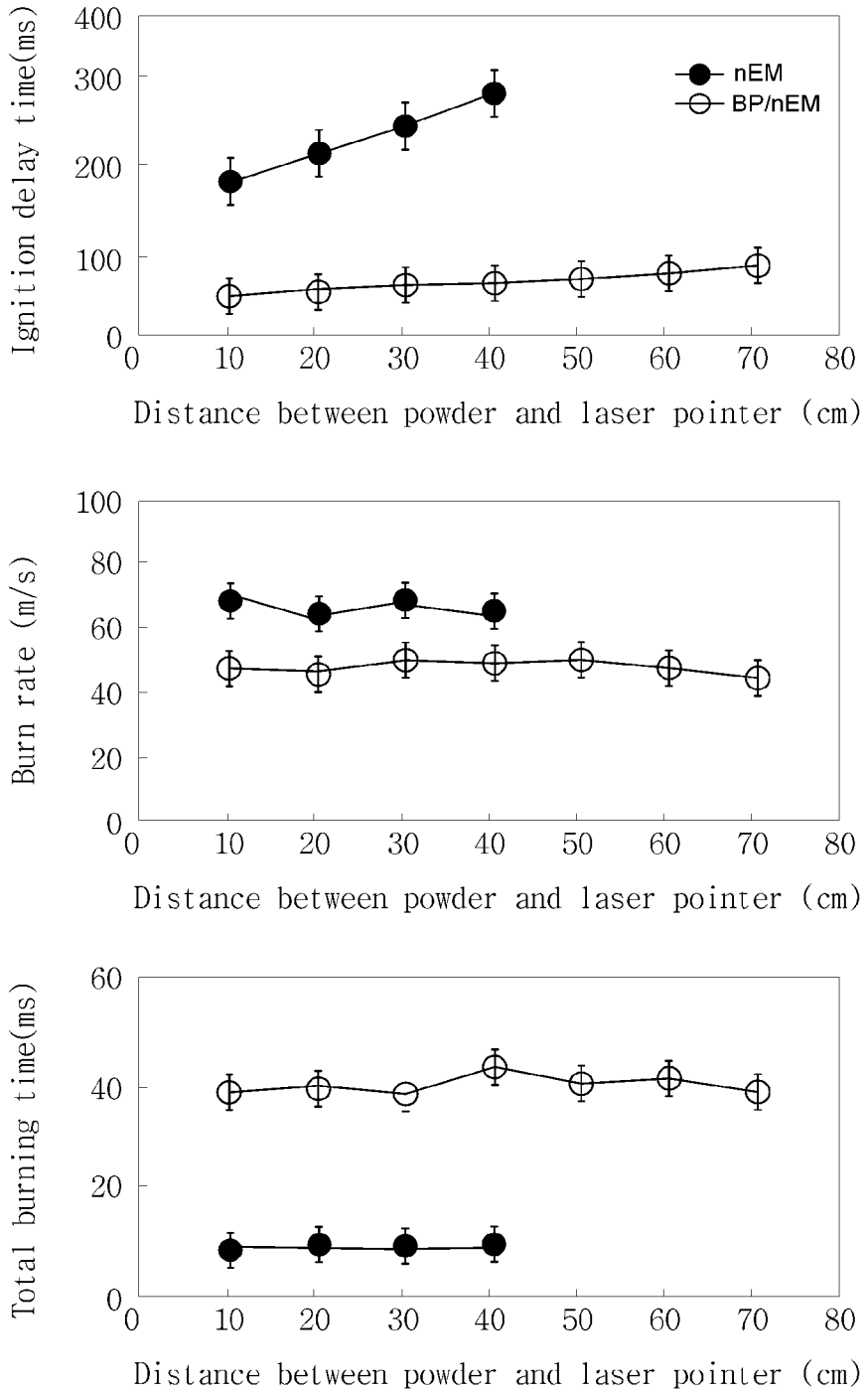
FIG. 8 is a graph showing ignition and combustion characteristics results of nEM powder and BP/nEM composite powder by a low-power laser pointer beam.

First, nEM powder is ignited by laser pointer beam irradiation while varying a distance between a laser pointer and the nEM powder, and the results thereof are shown in FIG. 8.

The nEM powder is ignited after a certain period of time when irradiated with a laser beam up to a maximum distance of 40 cm between a laser pointer and the nEM powder. However, unlike the nEM powder, as illustrated in FIG. 8, it is observed that the BP/nEM composite powder is ignited after a certain period of time passes when irradiated with the same light energy even up to a maximum of 70 cm.

Ultimately, it is determined that this is due to the fact that C, S, and $KNO_3$ as constituents included in BP are ignited even by heat generated by absorption of relatively low laser light energy, and such local initial ignition heat is gradually transferred to neighboring nEM particles, which leads to consecutive explosions.

Explosion characteristic values of the nEM powder and the BP/nEM composite powder by laser pointer beam ignition are compared with each other, and comparison results are shown in Table 1 below.

As shown in Table 1, it can be observed that, as the distance between a laser pointer and powder increases, the intensity of laser beam energy (laser power per unit area) reaching a surface of the powder linearly decreases.

When viewed based on the intensity of energy per unit area obtained by dividing the intensity of laser pointer beam energy by an area of a beam, it is determined that a minimum energy per unit area of about 600 $mW/mm^2$ or more is needed for combustion of the nEM powder, and a minimum energy per unit area of about 400 $mW/mm^2$ or more is needed for combustion of the BP/nEMs composite powder.

Based on these results, it is confirmed that minimum laser beam energy per unit area needed for the ignition and explosion of nEMs may be decreased by about ⅓ by addition of BP.

In addition, in Table 1, it can be observed that, as the distance between powder and a light source increases, the intensity of laser beam energy per unit area decreases and, accordingly, the initial ignition delay time of the nEM powder and the BP/nEM composite powder significantly increases, which ultimately means that nEM powder and/or BP/nEM powder need(s) a minimum ignition time for a temperature increase required for initial ignition by absorption of light energy.

However, even though initial ignition delay time increases due to an increase in distance between powder and a light source, a burn rate, a total burning time, or the like of the nEM powder or the BP/nEM powder is not significantly changed once the nEM powder or the BP/nEM powder is initially ignited. Based on this, it is determined that, after initial ignition by a laser pointer beam, combustion and explosion reaction rates of the nEM powder and the BP/nEM composite powder are not largely affected by optical ignition energy of an initially irradiated laser pointer beam.

Table 1 shows distance-based measurement results of laser power values per unit area, ignition delay time, total burning time, and burn rates of the nEM powder and the BP/nEM composite powder.

TABLE 1

| Distance between nEM and laser pointer | Absolute laser power | Laser beam area | Laser power per unit area | Ignition delay time (ms) | | Total burning time (ms) | | Burn rate (m/s) | |
|---|---|---|---|---|---|---|---|---|---|
| (cm) | (mW) | ($mm^2$) | ($mW/mm^2$) | nEM | BP/nEM | nEM | BP/nEM | nEM | BP/nEM |
| 10 | 200 | 0.20 | 1,000 | 191 | 47 | 10.13 | 39.23 | 69.5 | 48.3 |
| 20 | 200 | 0.24 | 833 | 227 | 53 | 9.73 | 40.26 | 65.6 | 46.2 |
| 30 | 200 | 0.28 | 714 | 262 | 59 | 9.83 | 38.82 | 69.5 | 50.8 |
| 40 | 200 | 0.33 | 606 | 304 | 63 | 10.06 | 43.54 | 66.6 | 49.5 |
| 50 | 200 | 0.38 | 526 | No Ignition | 68 | No Burning | 40.67 | N/A | 50.8 |
| 60 | 200 | 0.44 | 454 | No Ignition | 75 | No Burning | 41.94 | N/A | 48.7 |
| 70 | 200 | 0.50 | 400 | No Ignition | 83 | No Burning | 39.34 | N/A | 45.2 |
| 80 | 200 | 0.57 | 350 | No Ignition | No ignition | No Burning | No Burning | N/A | N/A |

FIG. 8 is a graph showing results of ignition and combustion characteristics of nEM powder and BP/nEM composite powder by a low-power laser pointer beam, i.e., ignition delay time ((a)), burn rate ((b)), and total burning time ((c)).

FIG. 8 is a graph showing ignition delay time, burn rate, and total burning time according to the distance between a laser pointer and each of the nEM powder and the BP/nEM composite powder.

As illustrated in FIG. 8(*a*), it can be confirmed that, as the distance between a laser pointer and the nEM powder increases, the ignition delay time of the nEM powder also increases in the same manner: from 191 ms@10 cm to 227 ms@20 cm to 262 ms@30 cm to 304 ms@40 cm.

Similarly, in the case of the BP/nEM composite powder, as the distance between a laser pointer and the BP/nEM composite powder increases, the ignition delay time thereof also increases: from 47 ms@10 cm to 53 ms@20 cm to 59 ms@30 cm to 63 ms@40 cm to 68 ms@50 cm to 75 ms@60 cm to 83 ms@70 cm.

In this regard, the BP/nEM composite powder has an overall relatively shorter ignition delay time than that of the nEM powder, and it is determined that this is due to the fact that BP added to the nEM requires relatively low initial ignition energy needed for ignition and combustion reactions.

However, from the results that a slope of the ignition delay time of the BP/nEM composite powder vs. the distance between a laser pointer and powder is more gentle than a slope thereof in the case of the nEM powder, it can be confirmed that the BP/nEM composite powder is less sensitive within a given distance range of 10 cm to 70 cm with respect to the intensity of laser pointer beam per unit area.

This means that a laser beam intensity range for the BP-free nEM powder, enabling ignition with a laser pointer, is very limited, while an ignitable area by laser beam of the BP/nEM composite powder becomes very wide due to addition of BP.

However, as illustrated in FIGS. 8(*b*) and 8(*c*), both the nEM powder and the BP/nEM powder do not exhibit a remarkably changed behavior in burn rate and total burning time even when the distance between a laser pointer and powder increases, from which it can be confirmed that consecutive combustion and explosion reactions progress very fast when nEM powder is locally ignited by a laser pointer beam, and thus there is no significant difference therebetween in a macroscopic area.

Finally, low-power laser pointer beam ignition results of the nEM powder are compared with those of the BP/nEM composite powder, and, from the comparison results, it can be obviously confirmed that, when compared to the nEM powder, the BP/nEM composite powder has a relatively low combustion rate, a relatively long total combustion time, and a relatively short ignition delay time, and is ignitable by a low-power laser pointer beam in a wider distance range.

These results indicate that nEMs capable of being optically ignited through relatively low-power laser pointer beam irradiation by applying BP to nEM powder can be widely applied to a variety of thermal engineering applications.

As is apparent from the foregoing description, it will be understood that the present invention may be embodied in many modified forms without departing from the essential characteristics of the present invention.

Thus, embodiments set forth herein should be considered in an illustrative sense only and not for the purpose of limitation, the scope of the present invention is defined by the scope of the following claims, not by the above description, and all differences within the same scope should be interpreted as within the scope of the present invention.

INDUSTRIAL APPLICABILITY

The present invention relates to a nEM composite, and more particularly, to a nEM composite having explosion characteristics by optical ignition wherein BP is added to nEM composite powder to enable remote optical ignition, and a method of preparing the same.

What is claimed is:

1. A nano-energetic material (nEM) composite having an explosion characteristic by optical ignition, the nEM composite comprising:

nEM composite powder; and black powder (BP) mixed with the nEM composite powder and used as a mediator for initial ignition wherein the BP of the mixed BP and nEMs composite powder is ignited by a laser pointer beam while the nEM is not directly ignited by the laser pointer beam during the initial ignition, wherein ignition heat from the initial ignition causes the nEM to be continuously ignited and consecutively exploded, wherein a mass ratio of the mixed BP and the nEM composite powder is BP:nEM=2.3:7.7, wherein the BP is used as the mediator for the initial ignition under a condition of a laser pointer having a power of <1,500 mW/mm$^2$, wherein a minimum energy per unit area of the laser pointer beam is 400 mW/mm$^2$ or more for combustion of the mixed BP and nEMs composite powder.

2. The nEM composite of claim 1, wherein the nEM composite powder is a mixture of aluminum (Al) nanoparticles used as a fuel material and copper oxide (CuO) nanoparticles used as an oxidizer.

3. The nEM composite of claim 1, wherein the black powder is a mixture of carbon (C), sulfur (S), and potassium nitrate ($KNO_3$).

4. The nEM composite of claim 1, wherein, in remote ignition performed by laser pointer beam irradiation, a power intensity and irradiation distance of a laser pointer are controlled based on a pressurization rate, a combustion rate, an ignition delay time, and a total burning time.

5. A method of preparing a nEM composite having an explosion characteristic by optical ignition, the method comprising:

mixing nEM composite powder;

mixing black powder; and preparing nEM/black powder composite powder by mixing the nEM composite powder with the black powder, wherein the black powder of the nEMs/back powder composite powder is ignited by a laser pointer beam while the nEM is not directly ignited by the laser pointer beam during an initial ignition, wherein ignition heat from the initial ignition causes the nEM to be continuously ignited and consecutively exploded, wherein a mass ratio of the nEM/black powder composite powder is BP:nEM=2.3:7.7, wherein the black powder is used as the mediator for the initial ignition under a condition of a laser pointer having a power of <1,500 mW/mm$^2$, wherein a minimum energy per unit area of the laser pointer beam is 400 mW/mm$^2$ or more for combustion of the nEMs/black powder composite powder.

6. The method of claim 5, wherein the nEM composite powder is a mixture of Al nanoparticles used as a fuel material and CuO nanoparticles used as an oxidizer.

7. The method of claim 5, wherein the black powder is a mixture of C, S, and $KNO_3$.

8. The method of claim 5, wherein the mixing of the nEM composite powder comprises mixing Al nanoparticles and CuO nanoparticles at a mass ratio of Al:CuO=3:7.

9. The method of claim 5, wherein the mixing of the black powder comprises mixing activated carbon, S, and $KNO_3$ at a mass ratio of C:S:$KNO_3$=3:1:6.

10. The method of claim 5, wherein, in the mixing of the nEM composite powder and the mixing of the black powder, a mixing ratio of constituents varies depending on a pressurization rate, combustion rate, ignition delay time, and total burning time of the nEM/black powder composite powder.

* * * * *